US011763763B2

(12) United States Patent
Hung et al.

(10) Patent No.: US 11,763,763 B2
(45) Date of Patent: Sep. 19, 2023

(54) ELECTROPHORETIC DISPLAY DEVICE AND DRIVING METHOD FOR ELECTROPHORETIC DISPLAY DEVICE

(71) Applicant: E Ink Holdings Inc., Hsinchu (TW)

(72) Inventors: Chi-Mao Hung, Hsinchu (TW); Jia-Hong Xu, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/504,516

(22) Filed: Oct. 19, 2021

(65) Prior Publication Data

US 2022/0208131 A1 Jun. 30, 2022

(30) Foreign Application Priority Data

Dec. 24, 2020 (TW) ..... 109145866

(51) Int. Cl.
*G09G 3/34* (2006.01)

(52) U.S. Cl.
CPC ..... *G09G 3/344* (2013.01); *G09G 2370/027* (2013.01)

(58) Field of Classification Search
CPC ..... H04N 21/4532; H04N 21/44218; H04N 21/8456; H04N 21/4668; H04N 21/42203; H04N 21/4788; G06F 16/735; H04L 51/046
See application file for complete search history.

(56) References Cited

U.S. PATENT DOCUMENTS

| | | | |
|---|---|---|---|
| 7,337,407 | B1 | 2/2008 | Ogami et al. |
| 8,922,569 | B1 | 12/2014 | Tidd |
| 8,935,623 | B1 | 1/2015 | Ogami et al. |
| 10,231,103 | B2 | 3/2019 | Kumar et al. |

(Continued)

FOREIGN PATENT DOCUMENTS

| | | |
|---|---|---|
| JP | 2007148302 | 6/2007 |
| TW | 201403559 | 1/2014 |

(Continued)

OTHER PUBLICATIONS

Office Action of Taiwan Counterpart Application, with English translation thereof, dated Apr. 27, 2021, pp. 1-15.

(Continued)

*Primary Examiner* — Shaheda A Abdin
(74) *Attorney, Agent, or Firm* — JCIPRNET

(57) ABSTRACT

An electrophoretic display device and a driving method for electrophoretic display device are provided. The electrophoretic display device includes an electrophoretic display panel, a network module, a processor and an electrophoretic display driver. The network module is configured to transmit a panel information of the electrophoretic display panel to a web application programming interface. The processor is coupled to the electrophoretic panel and the network module. The processor is configured to receive an image information packet corresponding to the panel information via the web application programming interface. The electrophoretic display driver is coupled to the processor and the electrophoretic display panel. The processor makes the electrophoretic display driver drive the electrophoretic display panel to display an image information according to the image information packet.

4 Claims, 2 Drawing Sheets

(56) References Cited

U.S. PATENT DOCUMENTS 10,453,160 B2 10/2019 Ranney
2003/0177169 A1* 9/2003 Nutt ..... H04L 67/51 709/201
2005/0114490 A1* 5/2005 Redlich ..... H04L 12/4633 709/223
2009/0153529 A1* 6/2009 Masuda ..... G09G 3/20 345/204
2009/0219264 A1* 9/2009 Erol ..... G09G 3/344 345/204
2012/0081406 A1* 4/2012 Li ..... G02B 26/001 362/97.1
2013/0215142 A1* 8/2013 Park ..... G06F 3/1423 345/619
2013/0257847 A1* 10/2013 Lee ..... G09G 3/3688 345/92
2015/0003693 A1* 1/2015 Baca ..... G06F 21/00 382/124
2015/0228047 A1* 8/2015 Shirota ..... G09G 3/3629 345/522
2016/0059133 A1* 3/2016 Firouzbakhsh ..... A63F 13/795 463/31
2017/0092230 A1 3/2017 Kuwabara
2017/0180489 A1* 6/2017 Oh ..... H04L 67/16
2018/0122013 A1* 5/2018 Malhotra ..... G06Q 40/06

FOREIGN PATENT DOCUMENTS

TW M512173 11/2015
TW 201820182 6/2018

OTHER PUBLICATIONS

"Notice of Allowance of Taiwan Counterpart Application," with English translation thereof, dated Aug. 3, 2021, pp. 1-4.

* cited by examiner

ELECTROPHORETIC DISPLAY DEVICE AND DRIVING METHOD FOR ELECTROPHORETIC DISPLAY DEVICE

CROSS-REFERENCE TO RELATED APPLICATION

This application claims the priority benefit of Taiwan application serial no. 109145866, filed on Dec. 24, 2020. The entirety of the above-mentioned patent application is hereby incorporated by reference herein and made a part of this specification.

BACKGROUND

1. Technical Field

The disclosure relates to a driving method, and in particular to a driving method of an electrophoretic display device and an electrophoretic display device.

2. Description of Related Art

When electrophoretic display technology is applied to end products (such as electrophoretic display devices, electronic papers), the information of drivers is often written in the processor, and the processor drives the electrophoretic display panel according to the information of drivers. Also, the information of drivers includes information such as the setting value of the driving IC and the driving method of the panel. In other words, the processor must be of a certain size to be able to load the information. However, with the trend toward smaller devices, the amount of information that may be loaded on smaller chips decreases. Therefore, it is the pursuit of people skilled in the art to drive the electrophoretic display panel smoothly while reducing the size of end products.

SUMMARY

The disclosure provides an electrophoretic display device and a driving method of an electrophoretic display device, which drives the electrophoretic display panel smoothly when the size of the end product is reduced.

For one or some or all of the above purposes or otherwise, an embodiment of the present invention proposes an electrophoretic display device including an electrophoretic display panel, a network module, a processor, and an electrophoretic display driver. The network module is configured to transmit a panel information of the electrophoretic display panel to a web application programming interface. The processor is coupled to the electrophoretic panel and the network module. The processor is configured to receive an image information packet corresponding to the panel information via the web application programming interface. The electrophoretic display driver is coupled to the processor and the electrophoretic display panel. The processor operates the electrophoretic display driver according to the image information packet so as to drive the electrophoretic display panel.

For one or some or all of the above purposes or otherwise, an embodiment of the present invention proposes a driving method of an electrophoretic display device including the following: transmitting a panel information of an electrophoretic display panel to a network application program interface via a network module; obtaining an image information packet corresponding to the panel information from the network application program interface via the network module; and operating an electrophoretic display driver according to the image information packet via a processor so as to drive the electrophoretic display panel.

Based on the above, according to the embodiments of the disclosure, the electrophoretic display panel can be driven according to the image information packet from the web application programming interface. In this way, the electrophoretic display panel can be driven smoothly while reducing the volume of the end product.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
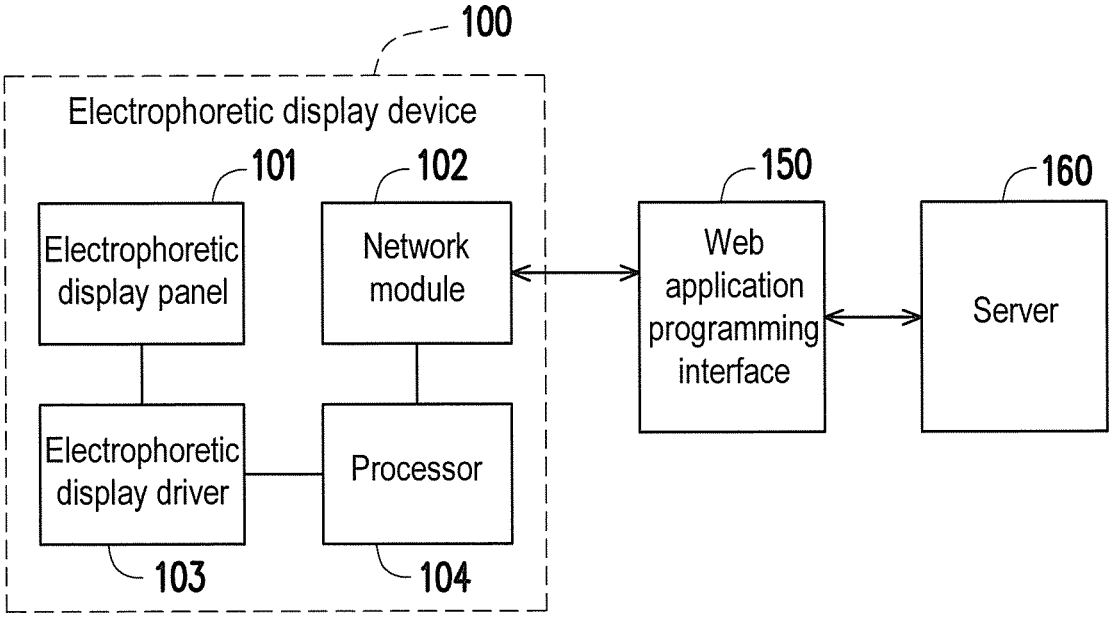
FIG. 1 is a functional block diagram of an electrophoretic display device, a web application programming interface, and a server according to an embodiment of the disclosure.

In order to make the contents of the disclosure easier to understand, the following embodiments are specifically cited as examples on which the disclosure may be implemented. Wherever possible, the originals/components/steps with the same reference numbers in the drawings and embodiments represent the same or similar parts.

And, unless defined otherwise, all terms (including technical and scientific terms) used herein have the same meaning as commonly understood by those of ordinary skill in the art to which the disclosure belongs. It will be further understood that terms such as those defined in commonly used dictionaries shall be construed to have a meaning consistent with their meaning in the context of the relevant art and the present invention and will not be construed to have an idealized or overly formal meaning unless expressly defined as such herein.

FIG. 1 is a functional block diagram of an electrophoretic display device, a web application programming interface (WEB API), and a server according to an embodiment of the disclosure. Referring to FIG. 1, an electrophoretic display device 100 may include an electrophoretic display panel 101, a network module 102, an electrophoretic display driver 103, and a processor 104. The processor 104 may be coupled to the network module 102 and the electrophoretic display driver 103. The electrophoretic display driver 103 may be coupled to the electrophoretic display panel 101 and the processor 104. In the present embodiment, the network module 102 may include, for example, a wired network module, a wireless network module, a Bluetooth module, an infrared module, a radio frequency identification (RFID) module, a Zigbee network module, or a near field communication (NFC) network module, but the disclosure is not limited thereto. In the present embodiment, the processor 104 may include, for example, a central processor (CPU), a microprocessor control unit (MCU), and a field programmable gate array (FPGA), but the disclosure does not limited thereto.

In the present embodiment, the electrophoretic display device 100 may further include a web application programming interface 150 and a server 160. The web application programming interface 150 may be connected to the network module 102 and the server 160 so as to receive a panel information of the electrophoretic display panel 101 from the of the network module 102. The panel information may be, for example, model information of the panel or barcode number corresponding to the panel, such that the panel model to which the electrophoretic display panel 101 belongs may be identified. Further, the web application programming interface 150 may transmit the panel information to the server 160. After the server 160 processes the panel information, the server 160 may transmit an image information packet corresponding to the panel information back to the web application programming interface 150. Then, the web application programming interface 150 transmits the image information packet to the network module 102. In the present embodiment, the network module 102 may sequentially receive, in a streaming manner, the image information packets transmitted by the web application programming interface 150. In the present embodiment, the image information packet may include image information, drive setting value, and drive voltage waveform information which correspond to the electrophoretic display panel 101. Then, the processor 104 may operate the electrophoretic display driver 103 according to the image information packet so as to drive the electrophoretic display panel 101, such that the electrophoretic display panel 101 displays the image information. Specifically, the processor 104 may set the electrophoretic display driver 103 according to the drive setting value. Moreover, the processor 104 may drive the electrophoretic display panel 101 via the electrophoretic display driver 103 according to the image information and the drive voltage waveform information, such that the electrophoretic display panel 101 displays the image information. In this way, the electrophoretic display device 100 can display the image information on the electrophoretic display panel 101 according to the image information packet from the server 160.

In the present embodiment, the drive setting value and the drive voltage waveform information corresponding to the electrophoretic display panel 101 may be stored in the server 160. Furthermore, the electrophoretic display device 100 may be directly or indirectly connected to the server 160 so as to obtain related driving information of the electrophoretic display panel 101. In other words, the processor 104 may not need to include the related driving information of the electrophoretic display panel 101 (such as the drive setting value and the drive voltage waveform information), thereby reducing the size of the processor 104. At the same time, a developer only needs to focus on application when designing, and only needs to set up the network module 102 for the communication in the electrophoretic display panel 101. The developer can turn on the electrophoretic display device 100 smoothly by just making a network request. Therefore, when a size of the electrophoretic display device 100 is reduced, the electrophoretic display panel 101 can also be driven smoothly. In addition, the developer does not need to understand basic technology and related settings of the electrophoretic display panel 101 during development, which can accelerate the development of device applications.

Figure 2:
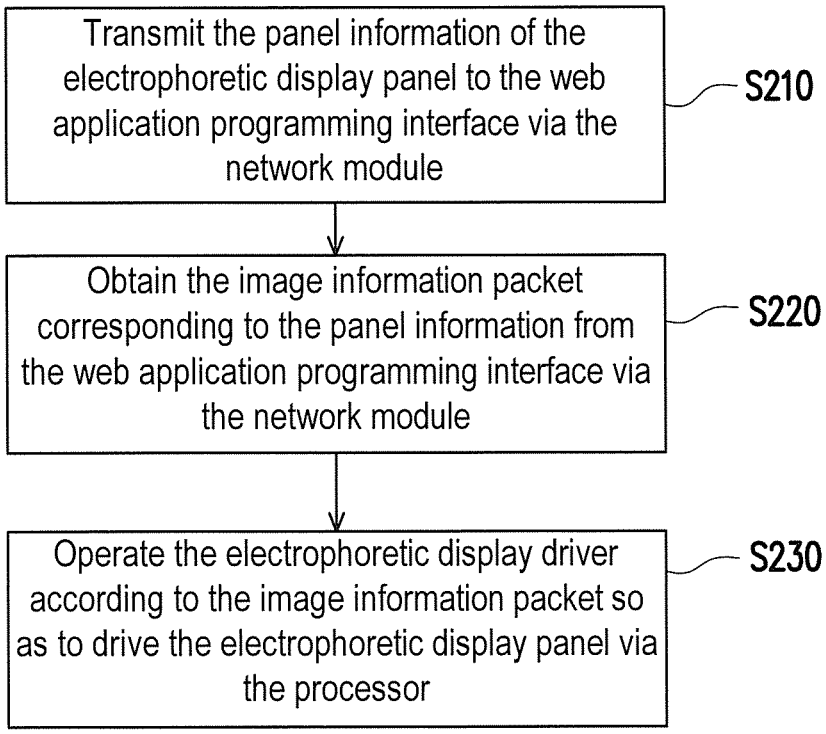
FIG. 2 is a flowchart of a driving method of an electrophoretic display device according to an embodiment of the disclosure.

FIG. 2 is a flowchart of a driving method of an electrophoretic display device according to an embodiment of the disclosure. Referring to FIG. 1 and FIG. 2, the electrophoretic display device 100 may perform the following steps S210-S230. In step S210, the electrophoretic display device 100 may transmit the panel information of the electrophoretic display panel 101 to the web application programming interface 150 via the network module 102. In step S220, the electrophoretic display device 100 may obtain the image information packet corresponding to the panel information from the web application programming interface 150 via the network module 102. In step S230, via the processor 104, the electrophoretic display device 100 may operate the electrophoretic display driver 103 according to the image information packet so as to drive the electrophoretic display panel 101. In this way, the electrophoretic display device 100 can operate the electrophoretic display driver 103 according to the image information packet so as to drive the electrophoretic display panel 101. Therefore, when a volume of the electrophoretic display device 100 is reduced, the electrophoretic display panel 101 can also be driven smoothly.

Figure 3:
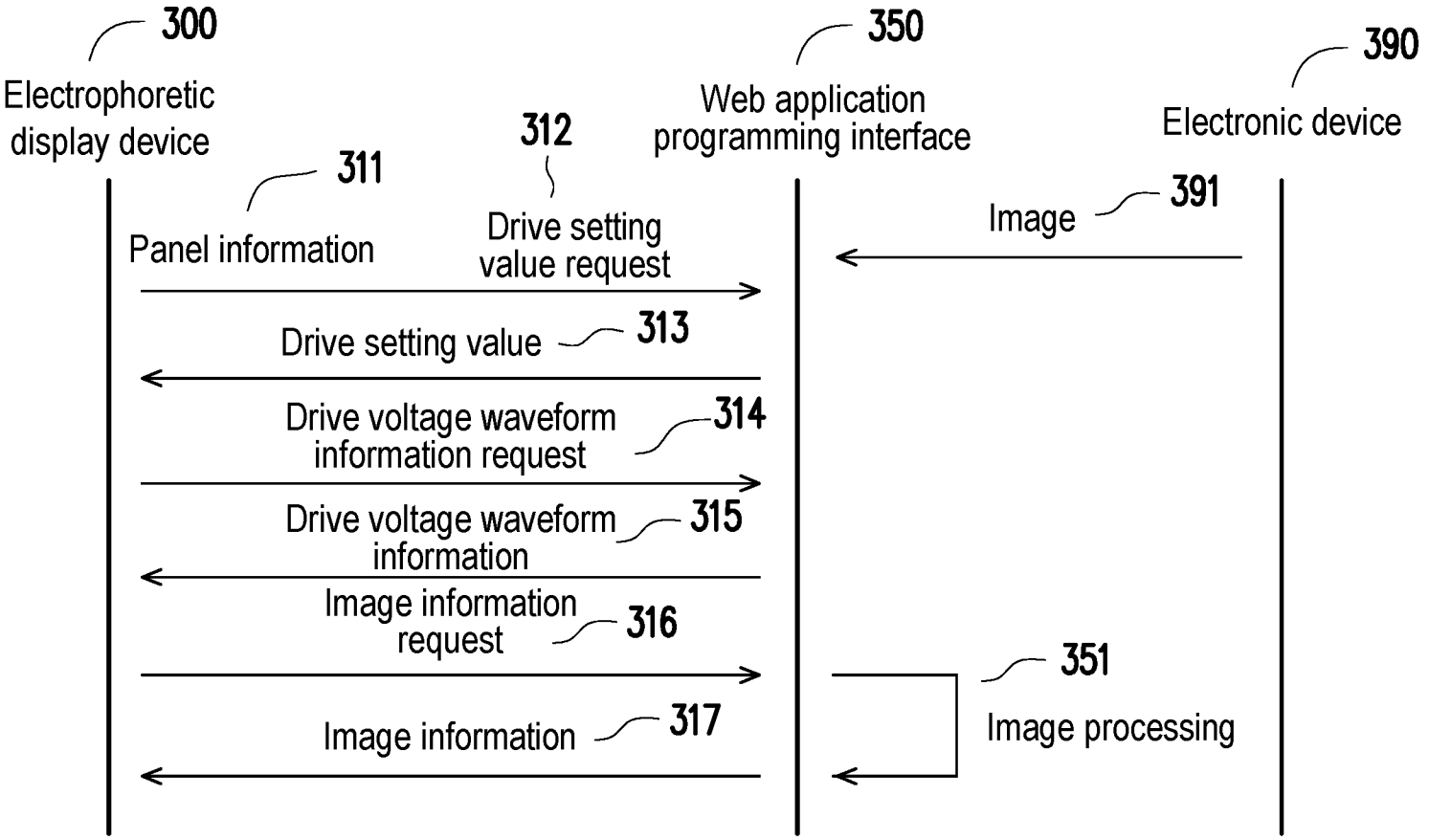
FIG. 3 is a schematic diagram of a driving method of an electrophoretic display device according to an embodiment of the disclosure.

FIG. 3 is a schematic diagram of a driving method of an electrophoretic display device according to an embodiment of the disclosure. Referring to FIG. 2 and FIG. 3, step S210 and step S220 of FIG. 2 may be performed according to the transmission method of FIG. 3. In the present embodiment, in step S210, an electrophoretic display device 300 transmits a panel information 311 of the electrophoretic display panel 101 to a web application programming interface 350, including transmitting the panel information 311, a drive setting value request 312, a drive voltage waveform information request 314, and an image information request 316 to the web application programming interface 350. In the present embodiment, in step S220, the electrophoretic display device 100 obtains the image information package from the web application programming interface 150, including obtaining from the web application programming interface 150 a drive setting value 313, a drive voltage waveform information 315, a drive voltage waveform information 315, and an image information 317 corresponding to the panel information 311. And, in the present embodiment, a user can transmit an image 391 to the web application programming interface 350 via an electronic device 390, such that the electrophoretic display device 100 displays the image information 317.

Specifically, referring to FIG. 3, the electrophoretic display device 300 may transmit the panel information 311 and the drive setting value request 312 to the web application programming interface 350. Then, the web application programming interface 350 may transmit the drive setting value 313 corresponding to the panel information 311 to the electrophoretic display device 300 according to the panel information 311 and the drive setting value request 312. Then, the electrophoretic display device 300 may transmit the drive voltage waveform information request 314 to the web application programming interface 350. The web application programming interface 350 may transmit the drive voltage waveform information 315 corresponding to the panel information 311 to the electrophoretic display device 300 according to the drive voltage waveform information request 314. Furthermore, the electrophoretic display device 300 may transmit the image information request 316 to the web application programming interface 350. In response to the image information request 316, the web application programming interface 350 may transmit the image information 317 to the electrophoretic display device 300. In this way, the electrophoretic display device 100 can display the image information 317 on the electrophoretic display device 300 according to the image information packet from the web application programming interface 350.

It is worth noting that, in the present embodiment, the image information 317 may be a result of the image 391 pre-loaded by the user via the electronic device 390 which underwent an image processing 351 via the web application programming interface 350. In other words, the web application programming interface 350 may transfer the image 391 to the server 160, and the server 160 may convert an image format of the image 391 according to the panel information 311, into a format suitable for the electrophoretic display device 300 via the image processings 351, so as to provide the image information 317 which underwent image format conversion to the network module 102 via the web application programming interface 350.

Referring to FIG. 1 and FIG. 3, the web application programming interface 350 receives the panel information 311, the drive setting value request 312, the drive voltage waveform information request 314, and the image information request 316 which come from the electrophoretic display device 300, and the image 391 of the electronic device 390 coming from the user, and uploads the above information to the server 160. Also, the server 160 may transmit the drive setting value 313, the drive voltage waveform information 315, and the image information 317 corresponding to the panel information 311 to the web application programming interface 350 according to the above information. In detail, the server 160 may perform the image processing 351 on the image 391 according to the panel information 311 and the image 391. Then, the server 160 transmits the image information 317 corresponding to the panel information 311 to the web application programming interface 350. In other words, the server 160 may perform different image processing 351 according to different electrophoretic display devices 300 to transmit the appropriate image information 317 to the electrophoretic display device 300. Moreover, the electrophoretic display device 300 may transmit and receive the above information via the network module 102, such that the electrophoretic display panel 101 displays the image information 317.

In summary, in the driving method of the electrophoretic display device and the electrophoretic display device of the disclosure, the electrophoretic display panel can be driven according to the image information packet from the web application programming interface. In this way, the electrophoretic display panel can be driven smoothly while reducing the volume of the end product.

Although the disclosure has been disclosed in the above embodiments, it is not intended to limit the disclosure. Anyone with ordinary knowledge in the relevant technical field may make slight changes and modifications without departing from the spirit and scope of the disclosure. The scope of protection of the disclosure shall be subject to those defined by the attached claims.

What is claimed is:

1. An electrophoretic display device, comprising:

an electrophoretic display panel;

a network module, transmitting a model information of the electrophoretic display panel and a driving setting value request to a web application programming interface;

a processor, coupled to the electrophoretic display panel and the network module, receiving an image information packet corresponding to the model information from the web application programming interface via the network module, wherein the image information packet comprises a drive setting value and a drive voltage waveform information which correspond to the model information; and an electrophoretic display driver, coupled to the processor and the electrophoretic display panel, wherein the processor operates the electrophoretic display driver according to the image information packet so as to drive the electrophoretic display panel, and the processor sets the electrophoretic display driver according to the drive setting value in the image information packet, wherein the image information packet further comprises an image information corresponding to the model information, and the processor drives the electrophoretic display panel via the electrophoretic display driver according to the image information and the drive voltage waveform information, wherein the image information is pre-uploaded by an external electronic device to a server having the web application programming interface, and the server converts an image format of the image information into a format for the electrophoretic display device via an image processing according to the model information, so as to provide the image information which underwent image format conversion to the network module via the web application programming interface, the model information comprises a panel model number of the electrophoretic display panel.

2. The electrophoretic display according to the claim 1, wherein the network module sequentially receives, in a streaming manner, the drive setting value, the drive voltage waveform information, and the image information transmitted by the web application programming interface.

3. A driving method of an electrophoretic display device, comprising:

a network module transmitting a model information of an electrophoretic display panel to a web application programming interface;

the network module obtaining an image information packet corresponding to the model information from the web application programming interface, wherein the image information packet comprises a drive setting value and a drive voltage waveform information which correspond to the model information; and a processor operating an electrophoretic display driver according to the image information packet so as to drive the electrophoretic display panel, wherein the processor operating the electrophoretic display driver according to the image information packet so as to drive the electrophoretic display panel comprises:

the processor setting the electrophoretic display driver according to the drive setting value, wherein the image information packet further comprises an image information corresponding to the model information, and wherein the processor operating the electrophoretic display driver according to the image information packet so as to drive the electrophoretic display panel further comprises:

the processor driving the electrophoretic display panel according to the image information and the drive voltage waveform information via the electrophoretic display driver, wherein the image information is pre-uploaded by an external electronic device to a server having the web application programming interface, and the server converts an image format of the image information into a format for the electrophoretic display device via an image processing according to the model information, so as to provide the image information which underwent image format conversion to the network module via the web application programming interface, the model information comprises a panel model number of the electrophoretic display panel.

4. The driving method according to the claim 3, wherein the network module sequentially receives, in a streaming manner, the drive setting value, the drive voltage waveform information, and the image information transmitted by the web application programming interface.

* * * * *